United States Patent [19]

Wysocki

[11] 4,228,945

[45] Oct. 21, 1980

[54] FOOD CARTON FOR MICROWAVE HEATING

[75] Inventor: Lawrence S. Wysocki, Chicago, Ill.

[73] Assignee: Champion International Corporation, Stamford, Conn.

[21] Appl. No.: 17,603

[22] Filed: Mar. 5, 1979

[51] Int. Cl.[3] ..... B65D 5/20

[52] U.S. Cl. ..... 229/30; 229/6 A; 229/27; 229/DIG. 14; 206/557; 220/258; 426/122; 426/113

[58] Field of Search ..... 206/557, 491.1, 491, 206/45.31, 45.32; 219/10.55 E, 10.55 M, 15; 220/406, 405, 258; 229/6 A, DIG. 14, 30, 27, 10; 126/290; 426/107, 113, 234, 24 B, 118

[56] References Cited

U.S. PATENT DOCUMENTS

| | | | |
|---|---|---|---|
| 702,106 | 6/1902 | Lewis | 229/6 A |
| 2,828,059 | 3/1958 | Ross | 206/557 X |
| 3,876,131 | 4/1975 | Tolaas | 426/113 |
| 4,046,307 | 9/1977 | Booth et al. | 229/15 |
| 4,065,583 | 12/1977 | Ahlgren | 420/113 X |
| 4,096,948 | 6/1978 | Kuchenbecker | 426/113 |
| 4,135,637 | 1/1979 | Hannula | 220/258 X |

*Primary Examiner*—Joseph Man-Fu Moy
*Attorney, Agent, or Firm*—Evelyn M. Sommer

[57] ABSTRACT

Disclosed is a carton which is especially adapted for heating food products in microwave ovens. The bottom surface of the carton is cut to define a plurality of spaced apertures, each of which is closed by removable means. A strip of film is secured to the bottom surface of the carton and the removable means so that, upon removal of the film prior to heating, the means are removed with the film to provide vent holes which allow moisture vapor generated during heating to escape. In a preferred embodiment, the carton has two separable compartments joined by a common top and two common side walls with an intermittent cut line extending across the top and down the common side walls to permit separation of the two compartments. The compartments have individual bottom panels, each of which is cut to provide a plurality of removable tabs held within spaced apertures by spaced nicks.

4 Claims, 17 Drawing Figures

Fig. 7.
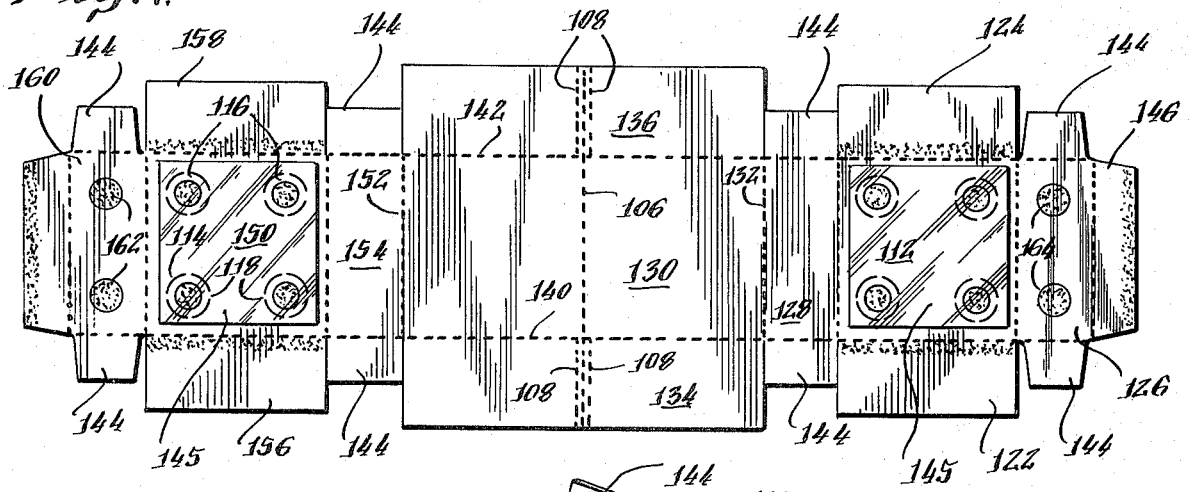
Fig. 8.
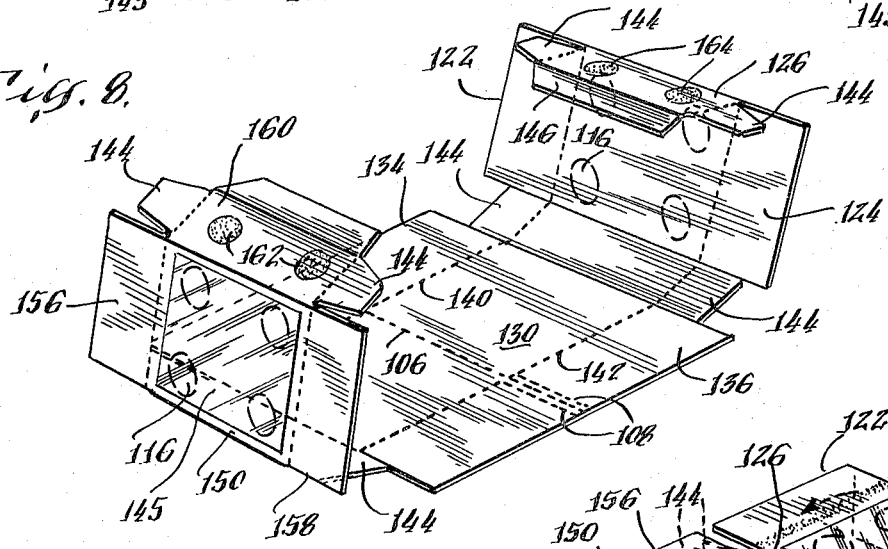
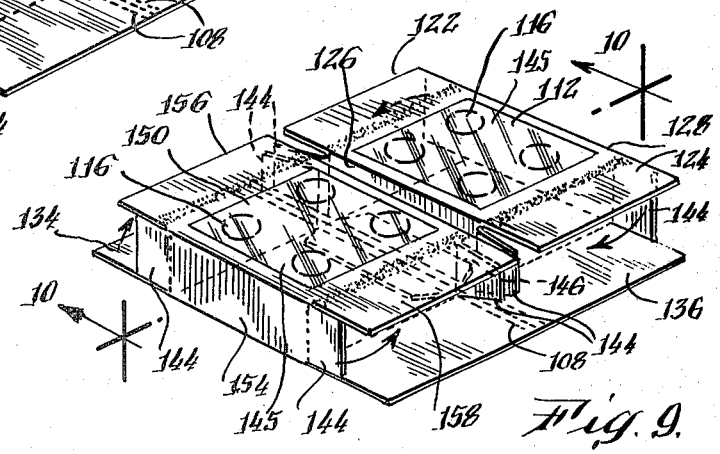
Fig. 9.
Fig. 10.
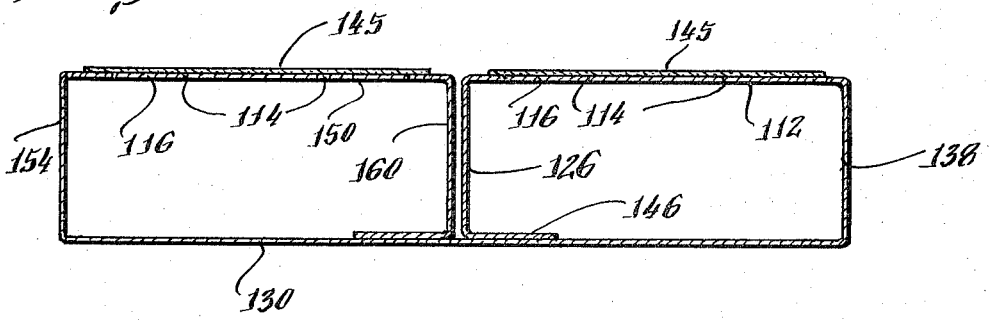

Fig. 11
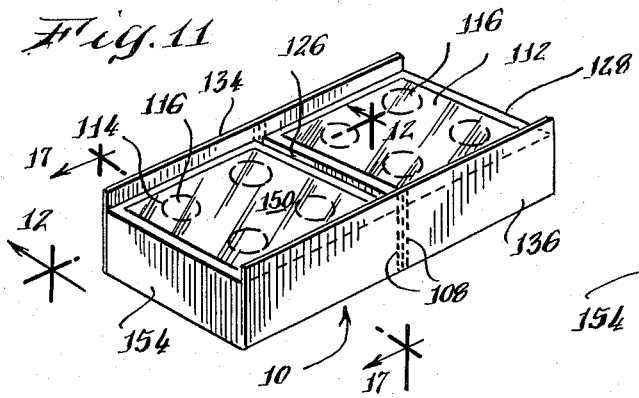
Fig. 12.
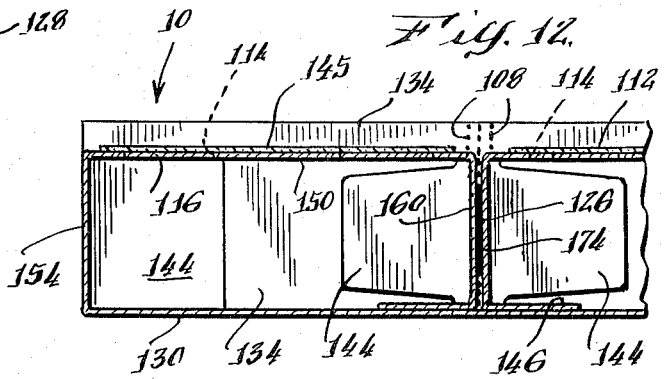
Fig. 13.
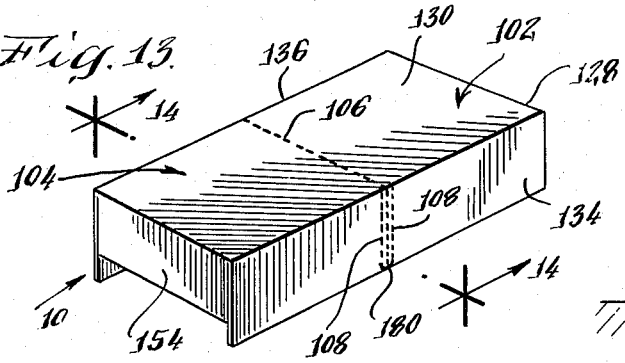
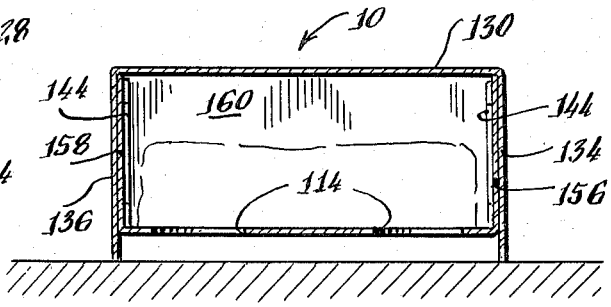
Fig. 14.
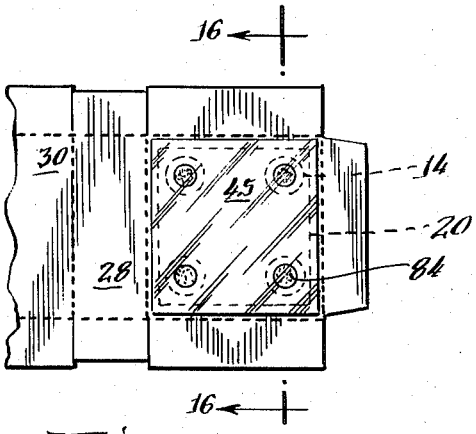
Fig. 15.
Fig. 16.
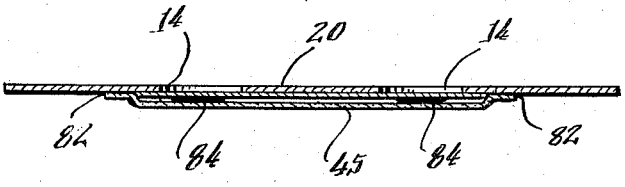
Fig. 17.
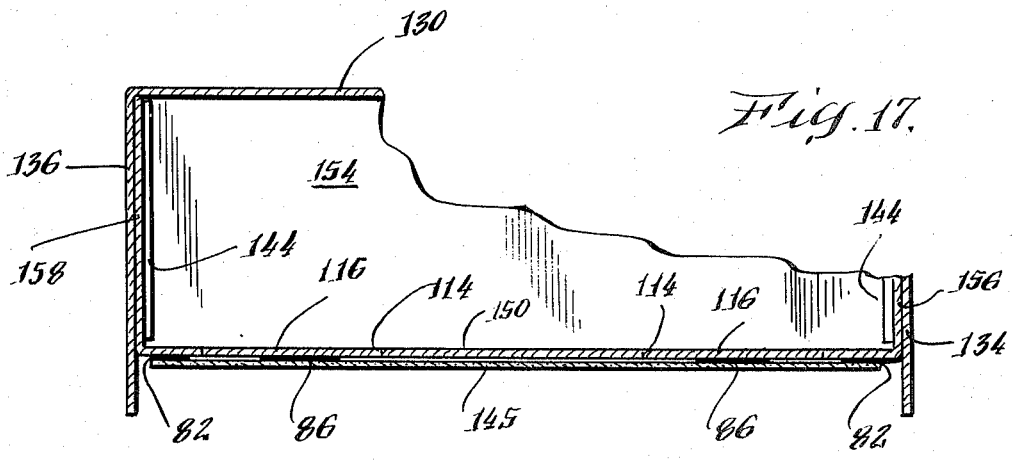

FOOD CARTON FOR MICROWAVE HEATING

BACKGROUND OF THE INVENTION

This invention relates to an improved carton for heating food products in a microwave oven, and more specifically to a carton of this type with integral vent means for permitting the release of mositure during heating.

In U.S. Pat. No. 3,876,131 and U.S. Pat. No. 29,185, it was recognized that packages useful for heating foods by microwave ovens must be vented to permit exhaustion of moisture vapors generated during the heating process, but yet must be sealed for protection of the food during shipment and storage. To meet these criteria, these patents disclose placing apertures in the bottom of the carton and covering these with a strip of film which could be removed prior to heating.

It was also found important to elevate the bottom surface of the carton from the microwave oven shelf so that the moist gases could be efficiently exhausted from the container. This requirement was met by provision of side wall panels which extended downwardly below the plane of the bottom surface of the container. In effect, the side walls formed legs which rasied the container above the support surface.

While the provision of vent holes and downwardly extending side walls did provide efficient exhaustion of gases from the container, there are certain product applications where open vent holes, even when covered with a strip of moisture barrier film, are disadvantageous from either the aesthetic or the protective viewpoint. Thus, it would be advantageous to provide a carton which enabled efficient venting, but which did not require the removal of portions of the container's structural wall prior to the time of heating.

Moreover, because of the ease and convenience of cooking in microwave ovens, consumers are frequently disposed to heat individual-sized portions of food for themselves where, previously, dishes of that nature would not be cooked individually due to the trouble and expense associated with heating a conventional convection oven. However, it is frequently desirable, when packaging foods for use in microwave ovens, to provide separable portions so that they can be cooked individually or as a group. Thus, it would be advantageous to provide a multi-unit package which is especially suited for heating the contents of either one or all of the compartments at the same time in a microwave oven.

SUMMARY OF THE INVENTION

It is an object of the present invention to provide a carton especially adapted for heating food products in a microwave oven which carton exhibits a continuous, outer paperboard structure which is rapidly provided with apertures for venting moisture generated during heating.

It is another object of the present invention to provide a carton especially adapted for heating food products in a microwave oven, which carton has a substantially continuous paperboard outer surface which can be selectively opened to provide vent holes for release of moisture generated during cooking by simply pulling off a strip of a moisture barrier film.

It is yet another object of the present invention to provide a carton especially adapted for heating a food product in a microwave oven, which carton has two compartments which can be separated or left together for cooking food products in a microwave oven.

It is still another and more specific object of the present invention to provide a carton especially adapted for heating a food product in a microwave oven, which carton has two compartments both having substantially continuous paperboard walls wherein vent holes can be opened by simply removing a strip of plastic material adhered to its surface, whereby the contents of one or both of the compartments can be heated.

These and other objects are accomplished according to the present invention which provides a carton including: a bottom panel cut to define a plurality of spaced apertures; removable means for closing said apertures; first side wall panels hinged to the edges of said bottom panel and extending upwardly therefrom; a top panel hingedly secured along one edge to one of said first side wall panels and extending substantially parallel to said bottom panel; second side wall panels hingedly secured to the two top panel edges adjacent to said one edge and extending downwardly therefrom and outwardly of said first side wall panels, said second side wall panels being secured to said first side wall panels and extended below the plane of said panel to support said bottom panel in spaced relation to a surface upon which said carton is placed; a strip of film secured to the under surface of said bottom panel by an adhesive applied to at least the outer periphery of said strip of film and said removable means; said strip being secured in a manner to permit its removal from said bottom panel while remaining adhered to said removable means to thereby open said apertures in said bottom panel. According to a preferred embodiment of the invention, the carton is constructed to contain two compartments joined by a common top panel and common second side wall panels having intermittent cut lines across said top panel and down said second side wall panels to permit separation of the carton into the two independent compartments, which further comprises: a second bottom panel cut to define a plurality of spaced apertures; removable means for closing said apertures in said second bottom panel; a second strip of film secured to the under surface of said second bottom panel by an adhesive applied to at least the outer periphery of said second strip and said removable means in said second bottom panel, said second strip being secured in a manner to permit its removal from said second bottom panel while remaining adhered to said removable means in said second bottom panel to thereby open said apertures in said second bottom panel; and third side wall panels hinged to the edges of said second bottom panel and extending upwardly therefrom; wherein the top panel is hingedly secured along the edge opposite said one edge to one of said third side wall panels; and the first and third side wall panels opposite those hingedly secured to the top panel, are adjacent one another.

BRIEF DESCRIPTION OF THE DRAWINGS

The invention will become better understood from the following detailed description, especially when read in light of the attached drawings wherein:

FIG. 7 is a diagrammatic view of a blank for forming a dual compartment carton according to the invention;

FIG. 8 is a perspective view showing partial folding in the assembly of the blank of FIG. 7 into a carton;

FIG. 9 is a perspective view of a further stage in construction of the blank shown in FIGS. 7 and 8, permitting viewing of the carton under surface;

FIG. 10 is a cross-sectional view taken along line 10—10 in FIG. 9;

FIG. 11 is a perspective view similar to FIGS. 8–10, showing complete assembly of the carton;

FIG. 12 is a cross-sectional view taken along line 12—12 in FIG. 11;

FIG. 13 is a perspective view showing the top of a carton assembled from the blank shown in FIG. 7;

FIG. 14 is a cross-sectional view taken along line 14—14 in FIG. 13;

FIG. 15 is a diagrammatic view showing an alternative embodiment for the removable means for covering the vent apertures;

FIG. 16 is a cross-sectional view taken along line 16—16 in FIG. 15; and

FIG. 17 is a cross-sectional view taken along line 17—17 in FIG. 11 showing the detail of the glue adhering the strip of film to the under surface of the carton and the removable means covering the vent apertures.

DETAILED DESCRIPTION OF THE INVENTION

Figure 1:
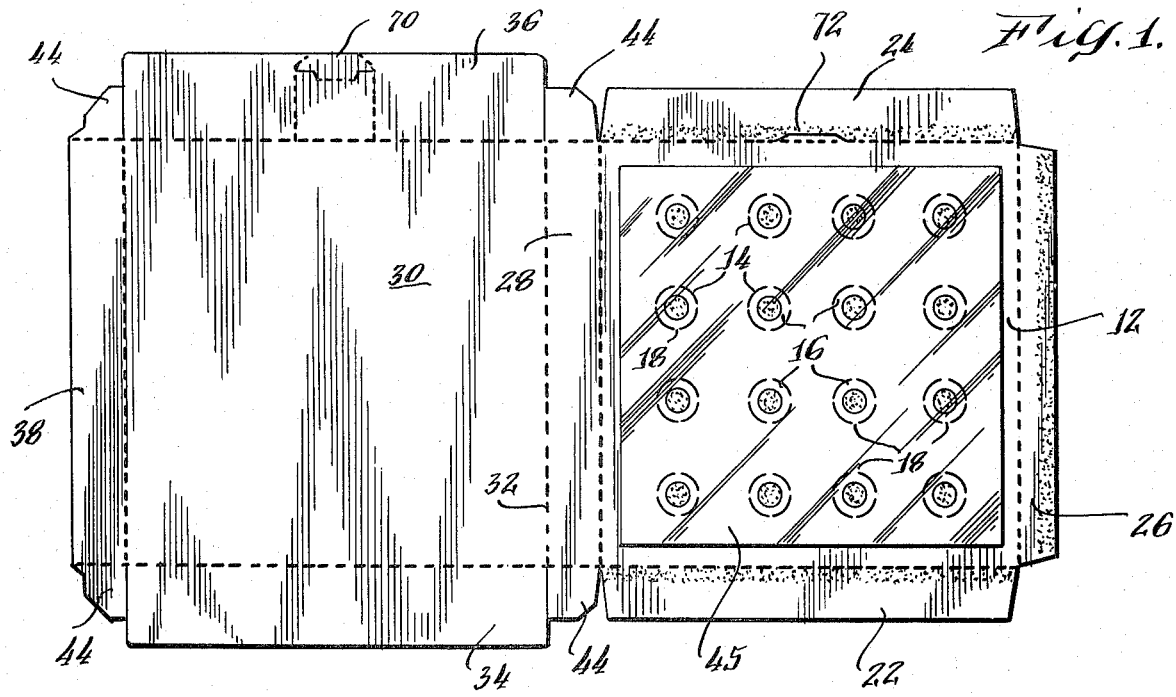
FIG. 1 is a diagrammatic view of a blank for forming a single compartment container according to the invention.
Figure 2:
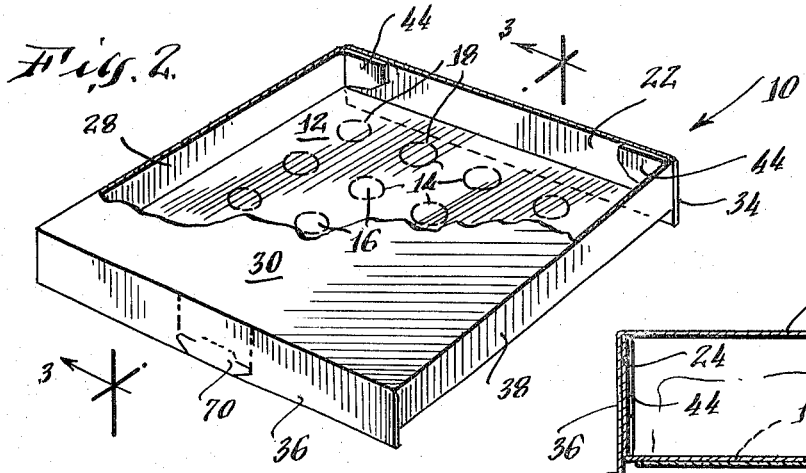
FIG. 2 is a perspective view of a carton made from a blank as shown in FIG. 1, partially cut away to allow viewing the bottom panel from the inside.

Referring to FIG. 1, there is shown a blank for forming a carton 10 as shown in FIG. 2. The carton 10 has a bottom panel 12 which is cut to define a plurality of spaced apertures 14. Removable means are provided for closing the apertures. In one embodiment, as shown in FIGS. 1–4, 7–13 and 17, the means comprise cutout tabs 16 which are held within the apertures 14 by a plurality of nicks 18 spaced about the periphery of the tabs. In the other embodiment as shown in FIGS. 15 and 16, a sheet of paperboard 20 overlies the apertures 14. These removable means for closing the apertures in the bottom panel 12 of the container 10 are necessary in certain instances for structural strength of the container and in other cases for consumer preference, An additional advantage of providing these removable means is that it provides a continuous surface upon which cooking instructions, required label information, or other printed matter can be included on this surface. Without removable means such as are provided according to this invention, the whole under surface of the container is lost for the purpose of providing printed matter.

Referring again to FIG. 1, there is shown a blank for constructing a carton of the type shown in FIG. 2. This blank, in addition to the bottom panel 12 and the apertures 14, has first side wall panels 22, 24, 26 and 28 hinged to the edges of the bottom panel 12. These first side wall panels are adapted to be folded about the indicated hinge lines to extend upwardly therefrom as shown in FIG. 2. FIG. 2 shows a partially cut away, fully-assembled carton 10 permitting viewing of the details of construction from the carton interior. A top panel 30 is hingedly secured along one edge 32 to one of said first side wall panels 28. The top panel 30 extends substantially parallel to the bottom panel 12 in the folded carton as shown in FIG. 2.

The carton blank shown in FIG. 1 also comprises second side wall panels 34, 36 and 38 which are hingedly secured to the edges of the top panel 30. Second side wall panels 34 an 36 are secured to the two edges 40 and 42, respectively, of the top panel 30 which are adjacent to said one edge 32 to which side wall panel 28 is secured. Second side wall panels 34, 36 and 38 bend downwardly from the top wall panel 30 in the final carton construction are preferably positioned outwardly of first side wall panels 22, 24 and 26 and corner tabs 44.

Figure 6:
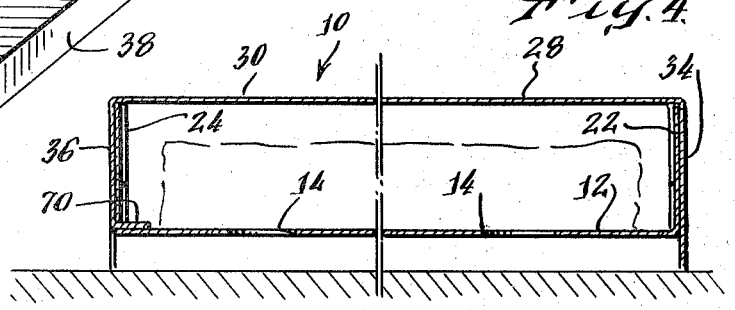
FIG. 6 is a cross-sectional view taken along line 6—6 in FIG. 5.

Second side wall panels 34 and 36 extend downwardly further than the distance between the top panel 30 and the bottom panel 12 in the folded carton as shown in FIG. 2. Thus, second side wall panels 34 and 36 space bottom panel 12 from a surface upon which the carton 10 is placed. When placed in a microwave oven for cooking, the bottom of the container 12 is spaced above the shelf in the oven to permit efficient exhaustion of moisture vapors generated during heating through holes 14 and out from the space between the carton and the shelf. This is shown in FIG. 6.

Figure 3:
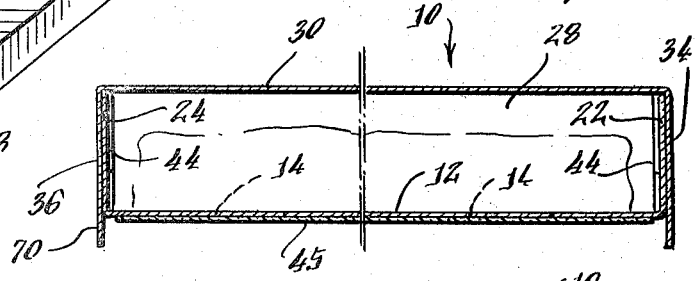
FIG. 3 is a cross-sectional view taken along line 3—3 in FIG. 2 showing a food product positioned inside the container.
Figure 5:
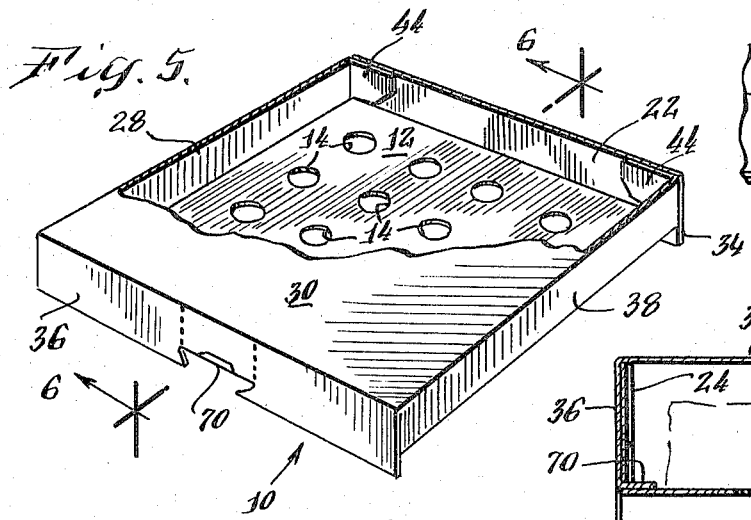
FIG. 5 is a perspective view of the carton shown in FIG. 2, but with the vent holes open and the male lock of the downwardly extending side wall panel inserted in locking position.
Figure 4:
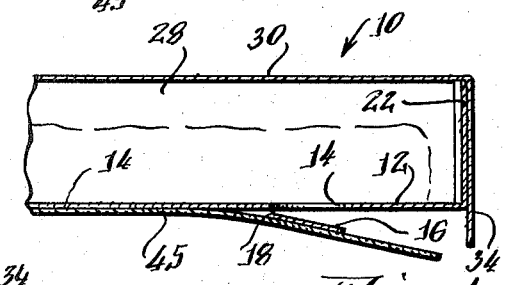
FIG. 4 is a cut away view similar to FIG. 3 showing partial removal of the strip of film from the bottom panel taking removable means with it to thereby open vent apertures.

A strip of film 45 overlies the under surface of the bottom panel 12 and is secured thereto by an adhesive applied to at least the outer periphery of the strip 45 and the removable means for closing said apertures. Thus, as shown in FIGS. 1 through 3, the film strip 45 is secured about its periphery to the bottom panel 12 and to the tabs 16 formed by the cuts 14 forming the apertures. FIG. 3 shows a sealed, assembled carton 10 having product within it. FIGS. 16 and 17 show the detail of the gluing of the strip of film 45 to the removable means 16 in FIG. 17 and 20 in FIG. 16. In both Figures, glue line 82 extends around the periphery of strip 45. In FIG. 16, glue 84 attaches film 45 to paperboard sheet 20. And, in FIG. 17, glue 86 adheres strip 45 to tabs 16. The strip of film 45 is secured in such a manner to permit its removal from the bottom panel while remaining adhered to the removable means to thereby open the apertures 14 in the bottom panel 12. Thus, as shown in FIG. 4, as the strip of film 45 is pulled from the bottom panel 12, tabs 16 are pulled loose from the retaining nicks 18 to open apertures 14. In the embodiment of FIGS. 15 and 16, as the film strip 45 is pulled from the bottom of container 12, the entire panel 20, which is adhered to the strip of film 45, and is removed thereby opening apertures 14. FIG. 5 shows a perspective, partially cut away view of an assembled container having the removable means removed, the carton being ready for heating.

According to a preferred embodiment of the present invention the carton is formed having two compartments. This is shown in FIG. 7 through FIG. 14. FIG. 7 shows a blank for forming a two compartment carton 110 as shown in various stages of assembly in FIGS. 8 through 14. Carton 110 in this embodiment will have two compartments 102 and 104 joined by a common top panel 130 and common second side wall panels 134 and 136. Intermittent cut lines 106 and 108 extend across the top panel 130 and down the second side walls 134 and 136 to permit separation of the carton into the two independent compartments 102 and 104. According to this embodiment, there are two bottom panels, a first bottom panel 112 and a second bottom panel 150. In the normal situation, both bottom panels will be of equal size and will be approximately one-half the size of the top panel 130. According to the embodiments shown in the drawings, both bottom panels 112 and 150 are cut to define apertures 114 wherein tabs 116 are held in place closing off the apertures 114 by virtue of a plurality of spaced nicks 118 about the periphery of each tab 116.

Attached to the first bottom panel 112 are first side wall panels 122, 124, and end wall panels 126 and 128 which, in the assembled carton 110, extend upwardly from the first bottom panel 112. End wall panel 128 is hinged to one edge 132 of top panel 130. Also secured to top panel 130 are second side wall panels 134 and 136 which are hinged at edges 140 and 142, respectively. Edges 140 and 142 are adjacent to the edge 132 to which end wall panel 128 is attached. Directly opposite edge 132 on top panel 130 is edge 152 to which a end wall panel 154 is hingedly secured. As shown in FIGS. 10–14, in the completed carton, end wall panel 154 as well as third side wall panels 156, 158 and end wall panel 160 extend upwardly from bottom wall panel 150. Two strips of film 145 are shown.

To assemble the carton 110, the two bottom panels 112 and 150 are bent underneath the top panel 130 about the associated hinge lines. This is clearly shown in FIGS. 8–10. The drawings further show how first side wall panels 122, 124 and end wall panel 126, and third side wall panels 156, 158 and end wall panel 160 are also bent upwardly to form the side walls for both compartments 102 and 104 of the completed container. To hold the side wall panels in this relationship, first sealing flap 146 which is associated with end wall panel 126, and second sealing flap 166 which is associated with end wall panel 160, are bent over and glued or otherwise secured to the inner surface of top panel 130. To complete construction of the container, all of the edge tabs 144 are bent inwardly and second side wall panels 134 and 136 are bent downwardly and secured to the associated first and third side wall panels 122, 124, 156 and 158. The final stage of assembly is apparent from FIGS. 9–11.

According to one embodiment of the invention as shown in FIGS. 1, 2 and 5, the second side wall panel 36 can have male locks to cut into the paperboard material. The male lock member 70 is designed to fit into slot 72 as shown in FIG. 1. Thus, it will be possible to package a food product in a separate wrapping within the carton 10 for extra protection, open the carton 10 to remove the inner wrapping, and then reinsert the food for heating, with the carton 10 secured in closed position by means of male member 70 which is inserted into slot 72. By virtue of this arrangement, not only can the aforementioned separate sealing of the internal product be advantageously employed, but the carton can be more readily utilized as a means for storing the unused portion of the product in the refrigerator for subsequent reheating.

The above-mentioned male locking member 70 and associated slot 72 may be utilized as a primary sealing means, if desired, however, sealing is preferably accomplished by use of flame sealing. Thus, all of the sealing to be accomplished according to the present invention can be done by straight-line, inplant gluing. This enables the adaptation of conventional packaging equipment to produce the container as presently set forth. This is a very important advantage of the present invention.

End wall panels 126 and 160 are opposite those side walls which are hingedly secured to the top wall; and, as can be seen in the drawings, are those which are folded toward the center of the container where compartments 102 and 104 meet. Thus, in the final folded container, end wall panel 126 is adjacent end wall panel 160. In the preferred embodiment of the invention, these side walls are secured to one another and are preferably secured at discrete locations. As seen in FIGS. 7 and 8, areas 162 are provided on end wall panel 160 which will mate with areas 164 on end wall panel 126. Both of these areas 162 and 164 are cut to a depth of from about 20 to about 60% of the thickness of the carton material, which is typically paperboard. The pattern of cutting will preferably be a circular configuration with cross-hatched cuts throughout the center of the circular scoring cut. In the particular embodiment shown, the cross-hatched cuts are separated at increments of about ⅛ of an inch and will be positioned such that the cuts in areas 162 are essentially perpendicular to the cuts in areas 164. In the preferred embodiment, glue will be applied only at these localized areas 162 and 164 such that the containers can be easily broken apart without destroying the structural integrity of either of the two compartments 102 or 104, but yet the two compartments will be tightly held together during storage and handling. The position of the glue is shown at 174 in FIG. 12.

To separate the two compartment carton and to its individual compartments 102 and 104, the compartments are first disengaged by tearing about lines 108. Then, the top panel 130 is bent to release any glue adhering panels 126 and 160, and is then ripped along perforated line 106 to fully separate the two compartments. According to a preferred embodiment of the present invention, a pull tab 180 as shown on second side wall panel 136 in FIG. 13, can be formed which will extend up the sides between spaced perforated lines 108. A like tab will also be placed on opposite second side wall 134. By pulling up on tabs 180 on either side of the container, the material between spaced intermittent cut lines 108 is removed, thereby permitting bending and ultimate separation of the two container portions 102 and 104.

Thus, an advantage of the present invention is that the cartons of the present invention can be formed from essentially continuous paperboard panels for the imprinting of various labeling information, and yet can be easily vented for heating by pulling a strip of film attached to removable means. This enables simple and effective venting of the carton for optimum heating in a microwave oven. Where the container is a single compartment container the operation can be accomplished by removing one strip of film. Where the carton of the invention comprises two compartments, the vents can be opened by removing one or both strips of film which overlie the bottom panels. It is possible, therefore, to separate the two compartments and store one with the vent holes remaining fully closed.

The above description is for the purpose of explaining the present invention to those skilled in the art, and is not meant to include all those obvious modifications and variations thereof which will become apparent upon reading. It is intended, however, that all such modifications and variations be included within the present invention, the scope of which is defined in the following claims.

What is claimed is:

1. A two part severable carton having venting apertures therein comprising:

first and second bottom panels each having a plurality of spaced tabs formed integrally therein, each of said tabs being defined by spaced cut lines to facilitate the removal of said tabs;

a strip of film secured to the undersurface of each said bottom panel by an adhesive applied to the bottom face of each said tab, said strip being secured in a manner to permit its removal from said bottom panels while remaining adhered to said tabs to thereby remove said tabs from said bottom panels to define venting apertures therein;

a pair of opposed first side wall panels hingedly connected to each said bottom panel and extending upwardly therefrom;

a pair of opposed end wall panels hingedly connected to the free edges of each said bottom panel and extending upwardly therefrom, with one of said end wall panels associated with each bottom panel being disposed in face to face abutting relationship and being adhesively connected at discrete locations therebetween;

a common top panel extending over both said bottom panels and being disposed parallel thereto, said top panel being hingedly connected to the top edge of the other said end wall panels;

a pair of opposed, common second side wall panels hingedly connected to the free side edges of said common top panel and extending downwardly therefrom, said second wall panels being disposed outwardly of said first side wall panels and being adhesively secured thereto, said second side wall panels extending below the plane of said bottom panels to support said bottom panels in spaced relation to a surface upon which said carton is placed; and said top and second side panels including a continuous line of perforation, said perforated line being disposed perpendicular to the hinged connection between said top and second side panels and lying in a plane coincident with the plane between said adhesively secured end wall panels whereby said carton may be separated into two individual parts by severing said line of perforation and breaking said adhesive connection between said one end wall panels thereby enabling the separation of said parts of said carton.

2. A two part carton according to claim 1 wherein said adhesively connected end panels are cut to a depth of from about 20% to 60% of the wall thickness in the areas adhered.

3. A two part carton according to claim 1 wherein the portions of said line of perforation formed on said second side wall panels comprise pairs of spaced intermittent cut lines which define pull tabs adapted to be grasped and pulled to separate said second side wall panels.

4. A blank for forming a carton as defined in claim 1.

* * * * *

UNITED STATES PATENT AND TRADEMARK OFFICE

CERTIFICATE OF CORRECTION

PATENT NO. : 4,228,945

DATED : October 21, 1980

INVENTOR(S) : Lawrence S. Wysocki

It is certified that error appears in the above–identified patent and that said Letters Patent are hereby corrected as shown below:

Column 1, line 22, before the word "efficiently" insert -- more --.

Column 2, line 24, before the word "panel" insert -- bottom --.

Column 8, claim 1, line 2, after the word "second" insert -- side --.

Signed and Sealed this

*Seventh* Day of *April 1981*

[SEAL]

*Attest:*

RENE D. TEGTMEYER

*Attesting Officer*

*Acting Commissioner of Patents and Trademarks*